US005263790A

United States Patent [19]

Bickley et al.

[11] Patent Number: 5,263,790

[45] Date of Patent: Nov. 23, 1993

[54] VEHICLE FOR FILLING POTHOLES

[75] Inventors: William E. Bickley, Nashville, Tenn.; Scott P. Kleiger, P.O. Box 120,841, Nashville, Tenn. 37212

[73] Assignee: Scott P. Kleiger, Morrisville, Pa.

[21] Appl. No.: 724,418

[22] Filed: Jul. 3, 1991

[51] Int. Cl.[5] ..... E01C 23/02; E01C 19/18

[52] U.S. Cl. ..... 404/107; 404/111; 404/108

[58] Field of Search ..... 404/75, 101, 107-111

[56] References Cited

U.S. PATENT DOCUMENTS

| | | | |
|---|---|---|---|
| 3,013,695 | 12/1961 | Caldwell | 404/108 X |
| 3,625,120 | 12/1971 | Nagy | 404/107 |
| 3,873,227 | 3/1975 | Goethe et al. | 404/107 |
| 4,511,284 | 4/1985 | Sterner | 404/108 X |
| 4,678,363 | 7/1987 | Sterner | 404/75 |
| 5,006,012 | 4/1991 | Sterner | 404/107 |
| 5,125,764 | 6/1992 | Veath | 404/108 |

*Primary Examiner*—Ramon S. Britts
*Assistant Examiner*—Roger J. Schoeppel
*Attorney, Agent, or Firm*—Louis Weinstein

[57] ABSTRACT

A vehicle for filling potholes and the like in roads with an asphalt-gravel mixture which comprises a wheeled chassis and driving motor, a gravel hopper, a tank for holding liquid asphalt, an extendable and retractable boom, a head applied on the boom for mixing and applying the asphalt-gravel mixture to desired road sites, a first hose carried along the boom and communicating between the hopper and the head, and a second hose carried along the boom and communicating between the tank and the head. Improvements in the disposition of the first and second hoses are provided, along with an improved valve for the gravel hopper, to greatly reduce wear in the apparatus during use and thus to reduce the need for maintenance.

20 Claims, 2 Drawing Sheets

*Fig. 1*
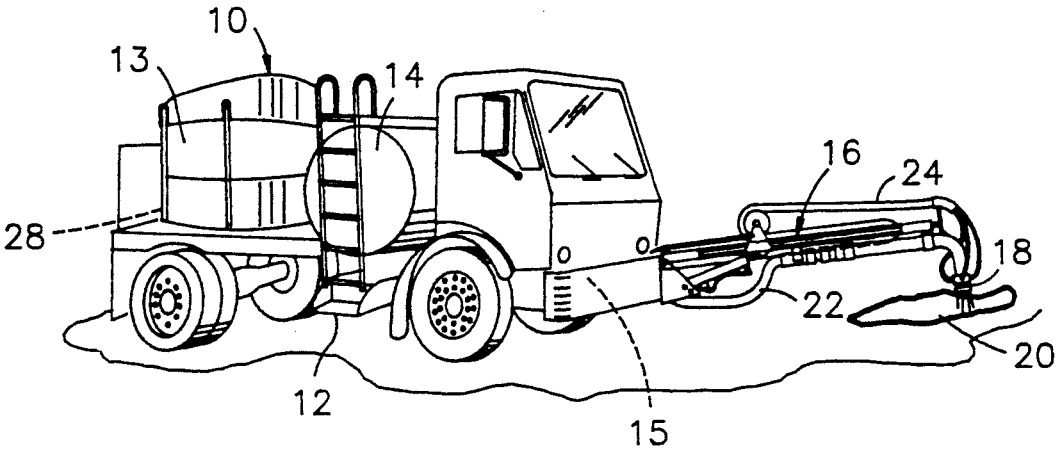
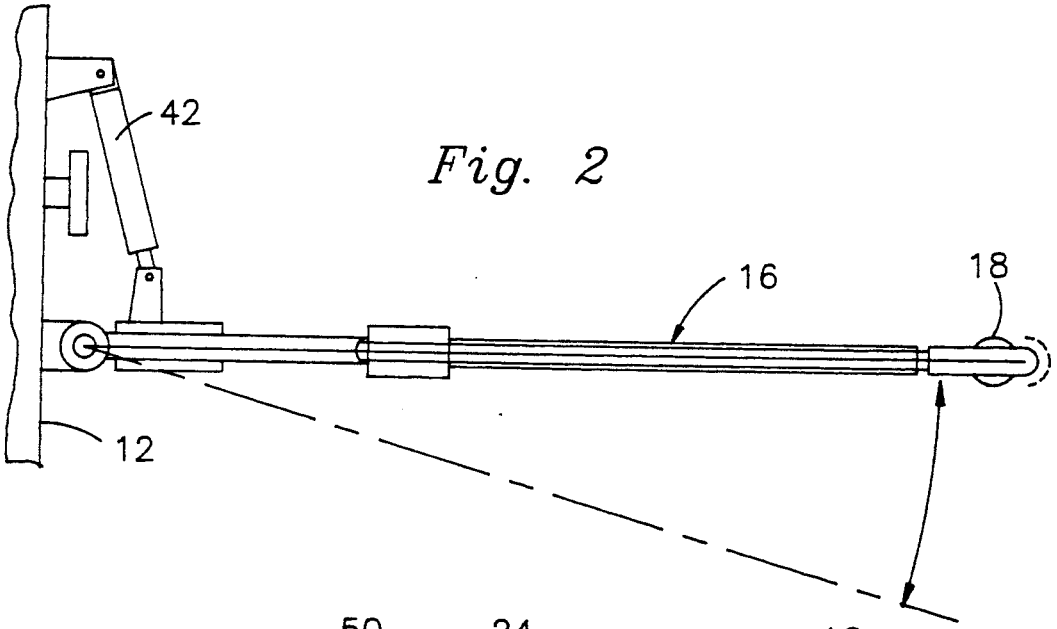
*Fig. 2*
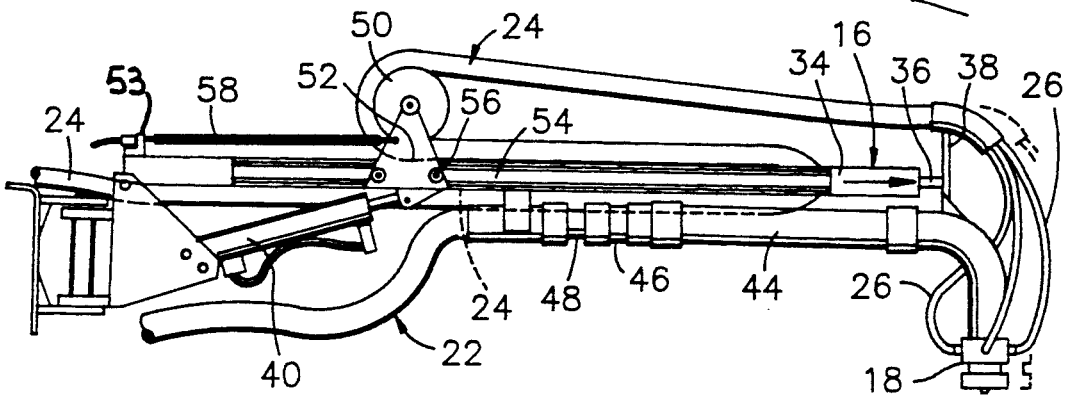
*Fig. 3*

VEHICLE FOR FILLING POTHOLES

BACKGROUND OF THE INVENTION

Potholes and the like in roads need to be repaired, typically by filling with a mixture of gravel and liquid asphalt. When the asphalt hardens on cooling, a strong, composite material results for long term repair of the pothole.

In the prior art, Automated Road Repair Systems, Inc. has sold a vehicle which comprises a motor-driven, wheeled chassis upon which there is carried a gravel hopper, a tank for holding liquid asphalt, and a pump for providing air pressure. Hoses extend respectively from the gravel hopper and the asphalt tank along an extensible and retractable boom at the front of the vehicle, to meet at a mixing head at the end of the boom. The gravel hose is connected to the air pressure source, the gravel hopper has a bottom aperture which communicates with the hose for the gravel, with the flow of gravel being controlled by a vane-type feeder valve, which is constructed rather like a horizontal revolving door.

In order to allow the outer end of the gravel hose to move with the extensible and retractable boom, the hose is carried on the boom, with the central portion of the hose defining a loop, to provide adequate slack so that the outer end of the hose can extend with the extending boom.

Thus, the outer end of the boom, carrying the mixing head, can be adjusted by controlling of the boom so that it is positioned over the pothole. Then, typically, the repair area is blown clean with the high velocity air that can come through the gravel hose, while the vane-type feeder valve does not permit gravel to enter the gravel hose. Then, from the asphalt supply, asphalt without gravel enters the head and is blown into the hole for repair. Following this, a mixture of gravel and asphalt is applied with high pressure air to the repair area until the pothole is filled. Typically, no rolling or tamping is required because of the use of the high pressure air.

Thus, the vehicle can be operated by one man, replacing an entire crew, to drive along a road, locate damaged areas, and fill them up with the mixture of gravel and asphalt, to repair the pothole or large road crack without the driver ever leaving the control cab of the vehicle.

While the vehicle of the prior art has been highly useful and beneficial, it exhibits certain shortcomings and drawbacks which have increased its cost of operation and limited its use.

For example, the vane-type control valve positioned at the bottom of the gravel hopper has been found to exhibit rapid wear, in view of the strong compressed air flow conditions mixed with gravel encountered by the vane valve. The periodic replacement of such a vane valve has been expensive and time consuming.

Also, the gravel hose has exhibited rapid rates of wear, in part because the hitherto-necessary loop in the gravel hose causes the rapidly moving gravel under high air pressure to impact internal walls thereof all the way around the loop, which seriously increases the wear. Thus, the gravel hose must be replaced on a relatively frequent basis, which is an expensive proposition. Additionally, the non-straight configuration of the gravel hose can sometimes increase the possibility of the gravel plugging up in the hose in a curved section thereof, which is, of course, a significant problem which requires halting of repair operations with the vehicle.

Also, the hose for the asphalt must be of an excessive length so that it can move outwardly with the extending boom. Thus, when the boom is in retracted position, the asphalt hose forms undesired loops and the like which have the risk of becoming entangled with each other or with other parts of the vehicle. Particularly, the asphalt hose in the retracted-boom configuration sometimes has a tendency to touch the ground, with resulting serious wear as the vehicle travels.

In accordance with this invention, the above problems are solved, with the result that an efficiently operating machine is provided, with significantly better wear characteristics of the asphalt and gravel hoses and the bottom valve of the gravel hopper. Thus, the improved vehicle of this invention has significantly reduced maintenance costs and maintenance time.

BRIEF DESCRIPTION OF THE INVENTION

The vehicle of this invention is for filling potholes and the like in roads with an asphalt-gravel mixture. It comprises a wheeled chassis and a driving motor, a gravel hopper, a tank for holding liquid asphalt, an extendable and retractable boom, and a head carried on the boom for mixing and applying the asphalt-gravel mixture to desired road sites.

First hose means is carried along the boom and communicates between the hopper and the head. Second hose means is also provided, being carried along the boom and communicating between the liquid asphalt tank and the head.

In accordance with this invention, the first hose means comprises telescoping sections which permit extension and retraction of the first hose means along with the extension and retraction of the boom, without the formation of bows or loops in the first hose means. Accordingly, the first hose means can continuously occupy a relatively straight path, to facilitate the transport of gravel therein and to reduce wear as it is extended and retracted along with the boom. It can be seen that the term "hose" is not intended to exclude a rigid section thereof. For example, the telescoping sections may be made of rigid metal or plastic.

In another aspect of this invention, a central portion of the second hose means, which conveys the liquid asphalt, occupies an S-shaped configuration. This is accomplished in part by the second hose being rearwardly looped around a pulley which is longitudinally slidingly carried on an inextensible portion of the boom. An outer end portion of the second hose is attached to an extensible portion of the boom. Thus, forward extension of the boom causes at least some of the second hose means to extend forwardly. This forward extension causes a changing of the shape of the S-shaped configuration of the second hose means, and the same forward extension of the second hose means also draws the pulley forwardly along the boom.

Preferably, spring means are present to urge the pulley rearwardly along the boom. Thus, a tension is imparted to at least a portion of the second hose means, to maintain its S-shaped configuration and to avoid the second hose means from forming undesirable loops, particularly a sagging loop that sags down far enough to engage the road. Generally, a relatively gentle tension is used, typically just enough tension to keep the second hose means from forming significant and undesirable sagging loop portions.

As another aspect of this invention, the gravel hopper of the vehicle defines a bottom first aperture. A plate defines a second aperture which is attached to the bottom of the gravel hopper, with the first and second apertures being positioned in registry with each other, so that gravel is capable of falling through the two apertures from the hopper.

An advanceable and retractable blade is slidable between the first and second apertures, to selectively open or to block off communication therebetween. When the blade is open, gravel will fall through the two registering apertures, when the blade is blocking off communication between the two apertures, then, of course, gravel does not flow from the hopper. The second aperture is below the first aperture, and is typically larger than the first aperture in at least the direction of sliding of the blade.

Thus, the flow of gravel through the aperture is controlled by the position of the blade. Gravel falling through the apertures, enters a plenum positioned below the apertures, with the plenum being connected to the first hose.

If desired, the plate and second aperture may be eliminated with just a sliding track for the blade being provided.

The increase in the size of the second aperture relative to the first aperture in the direction of sliding of the blade helps to prevent the jamming of the blade in its sliding path by grains of gravel. Particularly when the forward edge of the blade closes off the first aperture, but there is still a substantial amount of the second aperture around the forward edge of the blade, there is a strong tendency for pieces of gravel to fall away from the valve, and to cause jamming or wedging thereof in a manner to prevent closure of the valve and termination of the flow of gravel.

Preferably, means are provided for the blowing of air through the plenum and the first hose. This stream of blown air is of sufficient strength to propel gravel through the first hose and through the head. Also, as described above, the air blast may be used in the absence of gravel to blow out loose materials from a prospective repair site. Then, the same air can be used to blow hot, liquid asphalt into the repair site to form an adhesive coating, followed typically, by a mixture of asphalt and gravel applied to the pothole or other defect, being forcefully driven into its desired place by the air flow.

Preferably, the blade is carried on the end of a shaft. The shaft is moved back and forth by power means to control the position of the advanceable and retractable blade between open valve and closed valve positions. Turnbuckle means are provided in the shaft to permit adjustment of the length of the shaft, and thus to permit adjustment of the position of the blade.

BRIEF DESCRIPTION OF THE DRAWINGS

FIG. 1 is a perspective view of one embodiment of the vehicle of this invention;

FIG. 2 is a top plan view of the boom on the front of the vehicle of FIG. 1;

FIG. 3 is an elevational view of the boom of FIG. 2;

DETAILED DESCRIPTION OF SPECIFIC EMBODIMENTS

Figure 4:
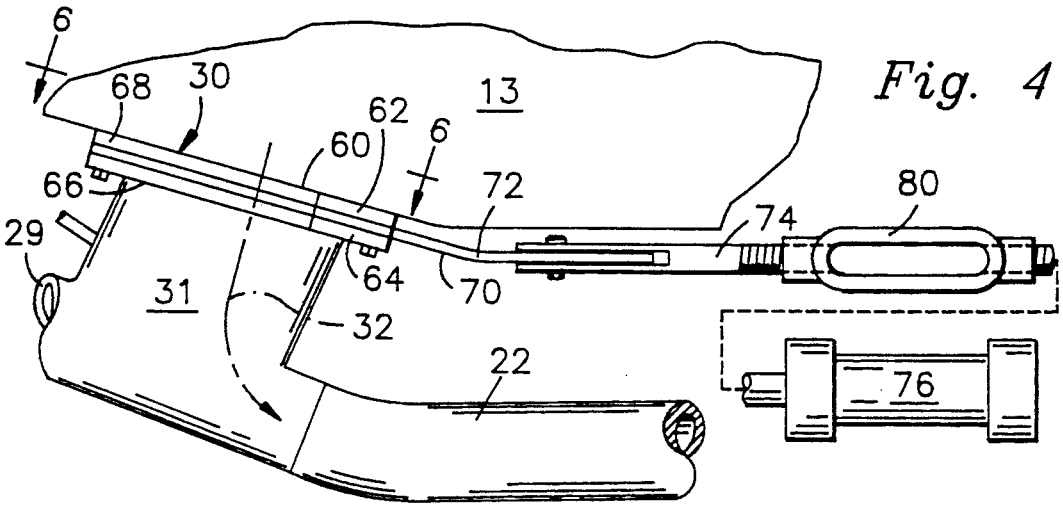
FIG. 4 is a fragmentary, detailed elevational view of the vehicle of FIG. 1 at the bottom of the gravel hopper.

Referring to FIG. 1, a vehicle for filling potholes and the like in roads with an asphalt-gravel mixture is disclosed in accordance with this invention. Vehicle 10 comprises a wheeled chassis 12, carrying a driving motor 15, being typically a standard truck chassis and motor, being modified and carrying components as described herein.

Vehicle 10 carries a gravel hopper 13 and a tank 14 for liquid asphalt, with a conventional heater to keep the asphalt in liquid form.

Vehicle 10 also carries an extendable and retractable front boom 16, which may be generally of conventional design except as otherwise described herein. Boom 16, in turn, carries a mixing head 18, which also may be of conventional design for the mixing of asphalt and gravel to cause a mixed asphalt-gravel composition 20 to be expelled from head 18 into road potholes and the like, as shown.

A first hose 22 is carried along boom 16 and communicates between hopper 13 and head 20, as shown in FIG. 1 and also in greater detail in FIG. 3.

A second hose 24 is also provided, being carried along boom 16 and communicating between asphalt tank 14 and mixing head 18. Particularly, it can be seen that at the outer end of hose 24, it divides into a plurality of branched sections 26 so that liquid asphalt can be applied radially inwardly of head 18 from a plurality of directions into the stream of gravel proceeding through the head via first hose 22.

An air compressor 28 of conventional design includes a conduit 29 which communicates with the rear end of first hose 22 (FIG. 4) to supply a blast of air to conduit 22. A supply valve 30 is provided at the bottom of hopper 13 so that gravel may be dropped into the air stream from air compressor 28 in a path which passes through first hose 22 in the manner illustrated by arrow 32 in FIG. 4. Thus, a blast of compressed air may be provided through head 18, without gravel or asphalt, to blow granular material out of a pothole. Then, if desired, a conventional control valve for asphalt tank 14 may be opened so that asphalt passes through second hose 24 in a relatively small quantity to coat the pothole with a layer of asphalt, being forcefully impelled out of head 18 by the stream of air through hose 22 by an aspiration principle. Then, valve 30 may be opened so that gravel falls into the air stream, and is forcefully passed through first hose 22 into mixing relation with asphalt from second hose 24, and from there the mixture 20 fills the pothole.

Boom 16 comprises an extension cylinder 34 having a plunger 36 that advances outwardly or retracts. Both hoses 22, 24 are attached thereto by cross bar 38, so that the outer ends of the hoses advance with the boom.

Boom 16 can pivot upwardly by the action of power cylinder 40 (FIG. 3), or it can pivot from side to side by the action of power cylinder 42 (FIG. 2). Thus, mixing head 18 of the boom 16 can be positioned throughout a substantial range of positions by the operator of the vehicle, so that the vehicle operator, from the cab of the vehicle, can properly position head 18 for filling a pothole, and then can fill the pothole in the manner previously described.

In accordance with this invention, certain disadvantages of the prior art vehicle, as described above, have been overcome. For example, the boom is inwardly and outwardly extensible and retractable, and the outer ends of the first and second hoses must travel with the outer end of the boom. In the prior art, first hose 22 had to be carried with a central loop configuration to accommodate this inward and outward moving. The onrushing gravel within first hose 22 caused a great deal of wear in the looped area, requiring frequent replacement of the first hose. Also, the problem of clogging could be a problem because of the substantial curvature of the first hose 22.

By this invention, the above problems are overcome by causing the first hose 22 to have a portion thereof which comprises telescoping sections 44, 46, 48, with the respective sections being of different diameters so that they can fit in telescoping relation within one another while remaining open. Preferably, the smallest diameter telescoping section 48 is positioned upstream from the next smallest diameter section 46, which is positioned upstream from the largest diameter telescoping section 44. Thus, gravel rapidly flying through hose 22 does not impact against the ends of the telescoping sections to cause damage.

Accordingly, it can be seen that the sliding, telescoping sections 44, 46, 48 can extend and retract with boom 16 as plunger 36 of the boom extends and retracts, while at the same time no loop is required in the first hose 22 to accommodate such extension, with the result that wear of the first hose 22 is greatly reduced. Also, because of the increased straightness of first hose 22 by this invention, the danger of clogging with blocked piles of gravel is reduced as well, to facilitate the transport of gravel therein.

By this invention, the mounting of second hose 24 is also improved. It also needs a substantial slack to accommodate the extension and retraction of boom 16. However, in the retracted position, it is, of course, important for second hose 24 to not along the ground, or to become so looped that it tangles in some way.

In accordance with this invention, second hose 24 is carried on boom 16 in an S-shaped configuration, as particularly shown in FIG. 3. Second hose 24 is rearwardly looped around a pulley 50. Pulley 50, in turn, is longitudinally slidingly carried on boom 16, with the bracket 52 that carries pulley 50 being slidable in groove 54 of the boom, which groove is typically provided on both sides of the boom cylinder 34. Rollers 56 are carried by bracket 52 on both sides to facilitate this sliding.

Spring member 58, coupled between movable bracket 52 and stationary bracket 53, is also provided to normally urge bracket 52 and pulley 50 into a rearward position so that a moderate amount of tension is placed on second hose 24.

Thus, when boom 16 expands its extension rod 36, the forward portion of second hose 24 is carried with it, and pulley 50 also slides forwardly to a certain extent, as the shape of the S-shaped configuration of second hose 24 is changed. Nevertheless, second hose 24 remains under tension because of the rearward pulling action of spring 58. Then, as boom 16 retracts, spring 58 draws second hose 24 rearwardly, and continuingly under tension, so that it can fold back into a deeper, S-shaped configuration once again.

Referring to FIGS. 4–7, another improvement of this invention is disclosed. In the prior art, a vane-type valve is provided to function in the manner of valve 30 as a control valve for the fall of gravel out of hopper 13. However, it has been found that such a vane-type valve wears rapidly under these particular conditions of use, because of the impacting of gravel against the vanes caused by the blast of air from air compressor 28 and its conduit 29.

In accordance with this invention, an improved control valve is provided. Gravel hopper 13 defines a first aperture 60, being typically provided by a first plate 62 over a gravel hopper aperture in its bottom wall, which plate is bolted to the bottom wall of gravel hopper 13.

A plate 64 defines a second aperture 66, with the first and second apertures 60, 66 being positioned in registry with each other. Between plates 62, 64 there is positioned a U-shaped plate 68 to provide a slot between the respective plates. Within this slot is positioned an advanceable and retractable blade 70. An angled bend 72 is shown in plate 70 in FIG. 4. Such a bend does not have to be present, and the system may be straight if desired. Otherwise, blade 70 is capable of flexing to accommodate the misalignment provided by bend 72.

Figure 5:
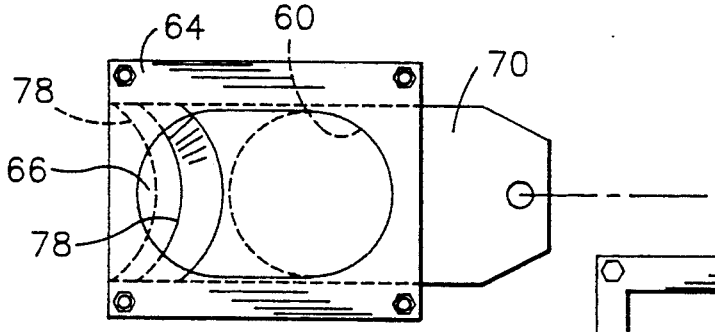
FIG. 5 is a bottom plan view, with portions removed, of the valve at the gravel hopper bottom.
Figure 7:
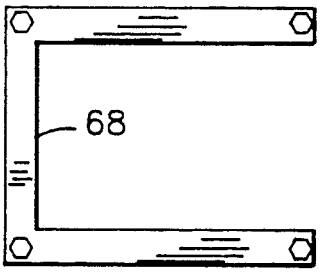
FIG. 7 is a plan view of an intermediate part of the valve of FIGS. 5 and 6.
Figure 6:
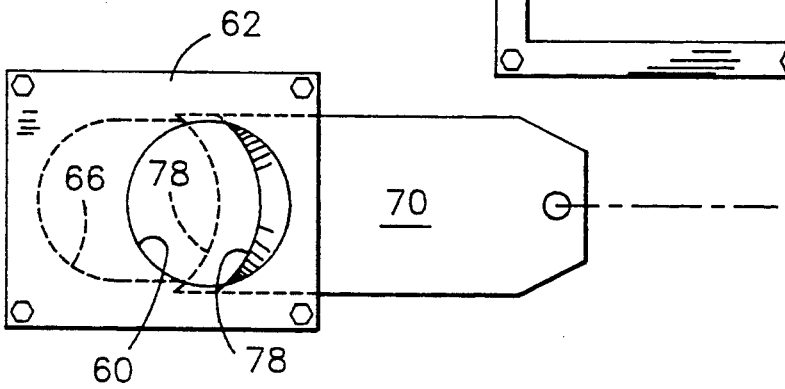
FIG. 6 is a top plan view taken along line 6—6 of the valve of FIG. 5.

Blade 70 is also connected to a shaft 74 which may be controlled by a hydraulic cylinder 76 at its end, to move shaft 74 between an advanced position and a retracted position in the slot between the first and second apertures 60, 66, to selectively open or block off communication therebetween. FIG. 5 shows an advanced position of blade 70, where aperture 60 is completely blocked. FIG. 6 shows an open position where aperture 60 is partially open, so that gravel can fall through aperture 60 and then aperture 66 into first hose 22 via plenum 31. Blade 70 is provided with a concave rear edge 78 to facilitate the flow of gravel through the apertures 60, 66 when the blade is in open position.

This valve system is adjustable to vary the amount of gravel flowing therethrough per unit time. A turnbuckle 80 is provided in shaft 74 to adjust the length of the shaft. This, in turn, adjusts the position of blade 70 in its respective open and closed positions as shown in FIGS. 6 and 5. In the open position, as turnbuckle 80 is moved, the position of blade 70 may be varied as illustrated by the respective full line position of edge 78 and the dotted line position of the same edge in FIG. 6, this position being as controlled by the turnbuckle. Thus, the area of the open aperture 60 can be adjusted, which, in turn, controls the drop rate of gravel therethrough. FIG. 5 shows a similar relationship in the closed position.

It can be seen that lower aperture 66 is longer than upper aperture 60 in the direction of sliding motion of blade 70. This provides the advantage of reducing the danger that gravel will jam up in the valve as blade 70 closes off aperture 60. Because aperture 66 is longer at the closing edge, gravel is more likely to fall away from the advancing blade edge 78 and not wedge or jam between the blade and an aperture edge.

Thus, an improved vehicle for filling potholes and the like is provided, which operates with substantially reduced wear, and thus needs less maintenance than the design of the prior art.

The above is offered for illustrative purposes only, and is not intended to limit the scope of the invention of this application, which is as defined in the claims below.

What is claimed is:

1. In a vehicle for filling potholes and the like in roads with an asphalt-gravel mixture, which comprises: a wheeled chassis and driving motor, a gravel hopper, a tank for holding liquid asphalt, a movable boom extendable and retractable over a predetermined range, a mixing head carried on said boom for mixing asphalt from said tank and gravel from said hopper and applying an asphalt-gravel mixture to desired road sites at a location determined by movement of said boom, first hose means carried along said boom and communicating between said hopper and said mixing head, and second hose means carried along said boom and communicating between the tank and the mixing head, the improvement comprising, in combination:

said first hose means comprising a plurality of substantially straight telescoping sections at least in the region of said boom to permit extension and retraction of said first hose means responsive to extension and retraction of said boom over said predetermined range, whereby said first hose means is maintained substantially straight in a region of said boom, regardless of the position occupied by said telescoping sections to facilitate transport of gravel therein to the mixing head and to reduce wear.

2. In a vehicle for filling potholes and the like in roads with an asphalt-gravel mixture, which comprises: a wheeled chassis and driving motor, a gravel hopper, a tank for holding liquid asphalt, a movable boom extendable and retractable over a predetermined range, a mixing head carried on said boom for mixing asphalt from said tank and gravel from said hopper and applying an asphalt-gravel mixture to desired road sites at a location determined by movement of said boom, first hose means carried along said boom and communicating between said hopper and said mixing head, and second hose means carried along said boom and communicating between the tank and the mixing head, the improvement comprising, in combination:

a central portion of said second hose means occupying an S-shaped configuration, said second hose means being rearwardly looped around a pulley which is longitudinally, slidingly carried on an inextensible portion of said boom, an outer end portion of said second hose being attached to an extensible end portion of said boom, whereby forward extension of said boom causers at least some of said second hose means to extend forwardly, causing the S-shaped configuration to advance in a forward direction, and said forwardly extending second hose means also draws said pulley forwardly along said boom.

3. The vehicle of claim 2 in which spring means normally urges said pulley rearwardly along said boom to impart tension to at least a portion of said second hose means.

4. The vehicle of claim 2 in which said gravel hopper has a first bottom aperture, a plate defining a second aperture attached to a bottom of said gravel hopper with said first and second apertures positioned substantially in registry with each other, an advanceable and retractable blade slidable between said first and second apertures to selectively open or block off communication therebetween, said second aperture being below said first aperture, whereby a flow of gravel through said apertures is controlled by movement of said blade, and a plenum positioned below said apertures, said plenum being connected to said first hose means.

5. The vehicle of claim 4 in which means are provided for blowing air through said first hose means to propel gravel through said first hose means and through said head.

6. The vehicle of claim 5 in which said blade is carried on an end of a shaft, and said shaft is moved back and forth by power means to control a position of said advanceable and retractable blade, and turnbuckle means in said shaft to adjust a length of said shaft and thus a position of said blade.

7. The vehicle of claim 6 in which said blade has a concave, forward edge.

8. The vehicle of claim 7 in which said second aperture is larger than said first aperture in at least a direction of sliding of said blade, to minimize jamming of gravel between said blade and an aperture wall.

9. The vehicle of claim 1 in which said gravel hopper has a first bottom aperture, a plate defining a second aperture attached to a bottom of said gravel hopper with said first and second apertures positioned in registry with each other, an advanceable and retractable blade slidable between said first and second apertures to selectively open or block off communication therebetween, said second aperture being below said first aperture, whereby a flow of gravel through said apertures is controlled by movement of said blade, and a plenum positioned below said second aperture, said plenum being connected to said first hose means.

10. The vehicle of claim 9 in which means are provided for blowing air through said first hose means to propel gravel through said first hose means and through said mixing head, and to clear debris from a surface when the slidable blade blocks off the flow of gravel from said hopper.

11. The vehicle of claim 9 in which said blade is carried to an end of a shaft, and said shaft is moved back and forth by power means to position said advanceable and retractable blade, and turnbuckle means in said shaft to adjust a length of said shaft and thus a position of said blade.

12. The vehicle of claim 11 in which said blade has a concave, forward edge.

13. The vehicle of claim 12 in which said second aperture is larger than said first aperture in at least a direction of sliding of said blade.

14. In a vehicle for filling potholes and the like in roads with an asphalt-gravel mixture, which comprises: a wheeled chassis and driving motor, a gravel hopper, a tank for holding liquid asphalt, an extendable and retractable boom, a mixing head carried on said boom for mixing and applying an asphalt-gravel mixture to desired road sites, first hose means carried along said boom and communicating between said hopper and the mixing head, and second hose means carried along said boom and communicating between the tank and the mixing head, the improvement comprising, in combination, said gravel hopper defining a bottom first aperture, a plate defining a second aperture attached to a bottom of said gravel hopper with said first and second apertures positioned substantially in registry with each other, an advanceable and retractable blade slidable between said first and second apertures to selectively open or block off communication therebetween, said second aperture being below said first aperture, whereby a flow of gravel through said first and second apertures is controlled by movement of said blade, and a plenum positioned below said second aperture, said plenum being connected to said first hose.

15. The vehicle of claim 14 in which means are provided for blowing air through said plenum and said first hose means to propel gravel through said first hose and through said mixing head.

16. The vehicle of claim 14 in which said blade is carried on an end of a shaft and said shaft is moved back and forth by power means to position said advanceable and retractable blade, and turnbuckle means in said shaft to adjust a length of said shaft and thus a position of said blade.

17. The vehicle of claim 14 in which the second aperture is larger than the first aperture in at least a direction of sliding of said blade, whereby jamming of gravel between the blade and a wall of an aperture is minimized.

18. In a vehicle for filling potholes and the like in roads with a road repair mixture, which vehicle comprises: a wheeled chassis and driving motor, a tank for holding a liquid repair material, an extendable and retractable boom, a mixing head carried on said boom for mixing and applying a mixture delivered thereto to desired road sites, hose means carried along said boom and communicating between the tank and the mixing head, the improvement comprising, in combination: a central portion of said hose means occupying an S-shaped configuration, said hose means being rearwardly looped around a pulley which is longitudinally slidingly carried on an inextensible portion of said boom, an outer end portion of said hose means being attached to an extensible portion of said boom, whereby forward extension of said boom causes at least some of said hose means to extend forwardly causing the S-shaped configuration to likewise advance in the forward direction, and said forwardly extending hose means also draws said pulley forwardly along said boom to prevent said first hose means from sagging.

19. The vehicle of claim 18 in which spring means urges the pulley rearwardly along said boom to impart tension to at least a portion of said hose means.

20. A wheeled vehicle for repairing a road surface comprising means for conveying flowable, solid matter from a source on said vehicle to a movable delivery outlet comprising:

telescoping conveying means including at least first and second elongated, substantially rigid, tubular members, an upstream end of said second member telescopingly receiving a downstream end of said first member;

conduit means coupled to said source for introducing solid matter into an upstream end of said first member to flow through said first member and out of a downstream end of said second member to said delivery outlet;

an inner diameter of said second member being greater than an outer diameter of said first member to reduce wearing of the telescoping conveying means; and means moving said second tubular member relative to said first tubular member to delivery solid matter to the delivery location.

* * * * *